US007964081B2

(12) United States Patent
Flotta et al.

(10) Patent No.: US 7,964,081 B2
(45) Date of Patent: Jun. 21, 2011

(54) ENHANCED MAGNETIC PLATING METHOD

(75) Inventors: Matteo Flotta, Fishkill, NY (US); Lubomyr Taras Romankiw, Briarcliff Manor, NY (US); Xiaoyan Shao, Yorktown Heights, NY (US); Steven Erik Steen, Peekskill, NY (US); Bucknell Chapman Webb, Ossining, NY (US)

(73) Assignee: International Business Machines Corporation, Armonk, NY (US)

( * ) Notice: Subject to any disclaimer, the term of this patent is extended or adjusted under 35 U.S.C. 154(b) by 918 days.

(21) Appl. No.: 11/844,587

(22) Filed: Aug. 24, 2007

(65) Prior Publication Data

US 2009/0050486 A1 Feb. 26, 2009

(51) Int. Cl.
*C25D 5/00* (2006.01)

(52) U.S. Cl. ..... 205/89; 204/DIG. 7; 205/90

(58) Field of Classification Search ..... 205/89, 205/90; 204/DIG. 7
See application file for complete search history.

(56) References Cited

U.S. PATENT DOCUMENTS

| | | | | |
|---|---|---|---|---|
| 3,117,065 | A * | 1/1964 | Wootten | 205/90 |
| 3,386,895 | A * | 6/1968 | Hunter | 205/89 |
| 5,312,532 | A * | 5/1994 | Andricacos et al. | 204/229.4 |
| 2007/0062816 | A1 * | 3/2007 | Chung et al. | 205/89 |
| 2007/0068801 | A1 * | 3/2007 | Diel et al. | 204/290.14 |

* cited by examiner

*Primary Examiner* — Alexa D Neckel
*Assistant Examiner* — William T Leader
(74) *Attorney, Agent, or Firm* — Michael J. Buchenhorner; Vazken Alexanian

(57) ABSTRACT

An apparatus for plating a magnetic film on a substrate includes: a track including a plurality of stopping points along the track; a permanent magnet placed on the track such that the permanent magnet can be moved along the track towards and away from the stopping points; at least one plating tank positioned on the stopping point; and a removable high permeability iron flux concentrator inserted into gaps between the substrate and inside walls of the plating tank, substantially surrounding the substrate and extending around and under the substrate.

11 Claims, 10 Drawing Sheets

ENHANCED MAGNETIC PLATING METHOD

CROSS-REFERENCE TO RELATED APPLICATIONS

None.

STATEMENT REGARDING FEDERALLY SPONSORED-RESEARCH OR DEVELOPMENT

None.

INCORPORATION BY REFERENCE OF MATERIAL SUBMITTED ON A COMPACT DISC

Not Applicable.

FIELD OF THE INVENTION

The invention disclosed broadly relates to the field of magnetic film plating and more particularly relates to scalable magnetic film plating.

BACKGROUND OF THE INVENTION

In the semiconductor industry the wafer size on which devices are fabricated has been steadily increasing, which has resulted in a dramatic decrease of cost per unit cell. The maximum size of wafers used in the fabrication of magnetic thin film heads has remained a steady size, between five and six inches in diameter, for many years. One of the key reasons for this is that it is necessary to provide a 1000 oersted (Oe) magnetic field at the center of the wafer during plating and also during annealing to overcome the demagnetizing field in the individual tiny devices and to achieve intrinsic magnetic anisotropy in the deposited magnetic films. The demagnetizing field greatly depends on the size, shape and thickness of the head features. Some assistance in overcoming the demagnetizing field is achieved by plating magnetic films through narrow photo resist frames providing pseudo continuous film but even that is not sufficient when the dimensions of the pattern become very small and at the same time it is necessary to make films relatively thick. The demagnetizing field at such edges, unless the films are laminated by a non-magnetic material, can reach the value of the saturation magnetization of the film and it becomes very difficult to achieve any degree of the intrinsic magnetic anisotropy in the deposited magnetic films.

Electroplating is typically performed in an electrolytic cell having an anode (positive electrode) and a cathode (negative electrode). The anode can have the same chemical composition as the material being plated, or it may contain only one element of the material being plated. The cathode is usually the object to be electroplated (usually a metal, ceramic, or polymer structure). The anode and cathode are enveloped in an electroplating solution or bath containing plating ions of the metals being plated. In the electroplating process, metallic plating cations fix on the cathode to form a thin layer of metal plating (such as chromium, copper, nickel, iron, silver, and/or cobalt) when an electric current is passed through the solution. The solution is generally a salt aqueous mixture.

Magnetic sensors and heads on disk drives and tape drives use magnetically anisotropic films formed by electroplating a magnetic alloy under the influence of an orienting magnetic field. The electroplated film exhibits magnetic anisotropy in the plane of the film, the direction of the orienting field applied during deposition becoming the longitudinal, preferred, or easy axis of magnetization in the plated coating; and the orthogonal direction becoming the transverse or hard axis of magnetization. It is desirable for the electrodeposited magnetic film to have a large high frequency magnetic permeability. Such magnetic films have a magnetic anisotropy; directional fields are typically used to switch the device from one direction to another.

The magnetic field used in electroplating is usually provided by a permanent magnet built around the plating tank so that the plating tank and the cathode holder with the wafer are sitting in the center of the horse shoe-shaped magnet. The cathode holder is generally stainless steel. To maximize the magnitude of the magnetic field the top surface of the wafer is placed at approximately the level of the pole tips of the magnet.

Using even the highest commercially available permanent magnets it has not been possible to achieve 1000 Oe in the middle of a plating tank capable of accommodating an 8-inch wafer. The magnetic field can be increased to 1000 Oe and beyond only by using an electromagnet. Electromagnetic use has its drawbacks. Electromagnets are much more costly than permanent magnets, much too big (they occupy ten to twenty times the volume of the permanent magnet), and they require such a high current and dissipate so much heat that it is necessary to water cool the magnet. This greatly increases the square foot area of the manufacturing plant. The electromagnets also require a much higher operating cost (cost of high current electricity and of the cooling water).

This is the key reason why the entire thin film magnetic head industry has used permanent magnets with a maximum wafer size of 6 inches. Electroplating is done in a magnetic field when plating magnetic films such as permalloy. An applied field in the plane of the plated film creates a uniform magnetic easy axis in the film. The magnet gap must be large enough to span the wafer and plating tank. This introduces a major limitation in the field strength and uniformity for magnets of reasonable cost with available hard magnet materials. For electromagnets, large coils are needed. Another drawback with permanent magnets is that the magnets are expensive and the magnetic field interferes with the insertion and removal of the anode, which is usually a magnetic material such Nickel or Cobalt.

Further processing of the magnetic films by heating the films in the presence of the in-plane field is used to further enhance the magnetic axis uniformity and magnetic permeability of the films. The drawback is that yet another magnet is needed for the annealing station. Existing systems use a magnet in a fixed location for each plating tank and an annealing station where the magnetic materials are entirely external to the plating tank.

There is a need for a method of fabricating magnetic storage heads to overcome the shortcomings of the prior art.

SUMMARY OF THE INVENTION

Briefly, according to an embodiment of the invention a method for enhancing a magnetic field when plating magnetic film on a substrate includes: loading the substrate into a plating tank; and introducing a conformable magnetic material into the plating tank. The conformable magnetic material acts as a high permeability iron flux concentrator and is inserted into gaps between the substrate and walls of the plating tank, substantially surrounding the substrate and extending around and under the substrate. The method proceeds with insertion of the anode, which is usually ferromagnetic, such as Nickel or Cobalt. The substrate is then electroplated using a permanent magnet surrounding the plating tank, wherein the permanent magnet magnetizes the conformable magnetic material; removing the magnetic anode from the plating tank; removing the electroplated substrate from the plating tank; and removing the conformable magnetic material from the plating tank.

According to an embodiment of the present invention, a tool for plating a magnetic film on a substrate includes: a track including a plurality of stopping points along the track; a permanent magnet placed on the track such that the permanent magnet can be moved along the track towards and away from the stopping points along the track; at least one plating tank positioned on the stopping point along the track; and a removable high permeability iron flux concentrator inserted into gaps between the substrate and inside walls of the plating tank, substantially surrounding the substrate and extending around and under the substrate. The method can also include a removable electroplating anode. According to another embodiment, the removal of the electroplating anode is facilitated by moving the permanent magnet away from the stopping point where the magnet is positioned close to the anode.

According to another embodiment of the present invention, a method for plating magnetic film on a substrate includes: mounting a permanent magnet on a track including a plurality of stopping points, wherein the permanent magnet is movable along the track; positioning a first cell on a first stopping point; positioning a second cell on a second stopping point; and moving the permanent magnet along the track to the first and second stopping points wherein the magnet surrounds the first and second cells, respectively, when positioned; and wherein the permanent magnet magnetizes the substrate disposed within the first and second cells. Further, a conformable magnetic material is introduced into the first and second cells, substantially surrounding the substrate. Further, the removal and insertion of a plating anode may be facilitated by repositioning the permanent magnet.

BRIEF DESCRIPTION OF THE DRAWINGS

To describe the foregoing and other exemplary purposes, aspects, and advantages, we use the following detailed description of an exemplary embodiment of the invention with reference to the drawings, in which.

Figure 1:
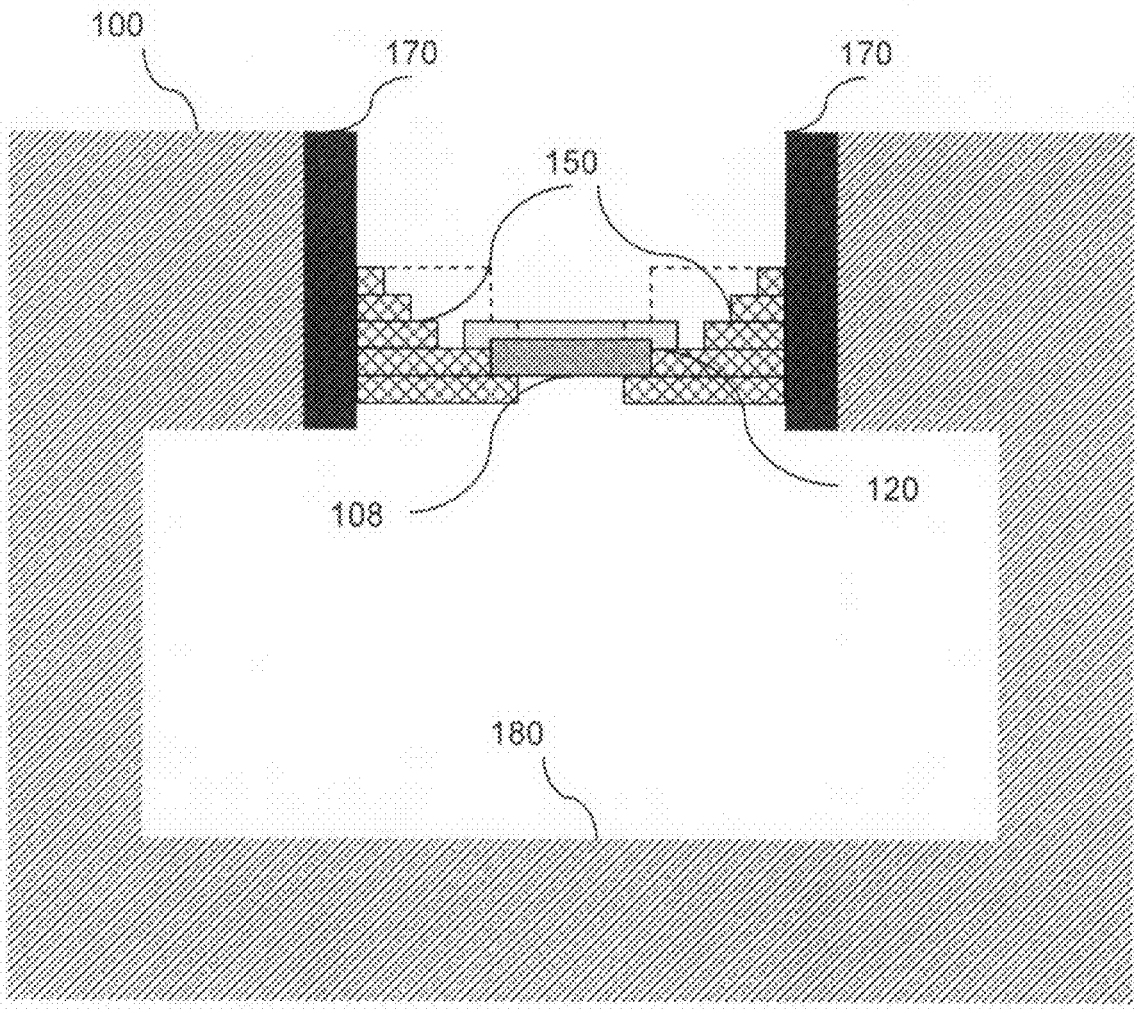
FIG. 1 is an illustration of soft magnetic poles, according to an embodiment of the present invention.

While the invention as claimed can be modified into alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the scope of the present invention.

DETAILED DESCRIPTION

We describe a tool and method for enhancing a magnetic field used in the plating of magnetic film. This tool and method overcomes the shortcomings of the prior art by increasing the magnetic field around a wafer. This in turn enables the use of a larger wafer, with no subsequent loss of magnetic strength as measured in oresteds (Oe). Also by improving the magnetic flux distribution, we achieve better magnetic orientation and magnetic anisotropy, thereby improving the operation of the magnetic heads. The increase in wafer size yields an increase in the number of magnetic heads which can be produced, while at the same time reducing manufacturing costs. The embodiments of the proposed tool and method, as will be described fully herein, can be advantageously used in any process involving the plating of magnetic films where an applied magnetic field is desired during plating, such as tape head manufacturing. For clarity, however, we focus our discussion on wafers in the fabrication of magnetic thin film heads.

According to one embodiment of the present invention, the magnetic field around a wafer is enhanced by replacing parts of the traditional stainless steel cathode on which the wafer is mounted with soft iron pieces surrounding the wafer. These "floating magnetic pole pieces" act as very high permeability iron flux concentrators all around the wafer. Since wafers are round there is space surrounding the wafer to be plated but clear of the mixing paddles or fountains. In addition there is usually space below the mixing paddles. According to this embodiment, the plating magnet still spans the exterior of the plating tank (electrolytic cell) but the magnetic field strength and uniformity around the wafer are enhanced by incorporating these additional magnetic poles between the tank walls and the wafer.

Shaping the soft iron or other soft magnetic material so that the pieces extend along the width of the entire wafer can double the magnitude of the measured magnetic field in the center of a plating tank (which is the center of the wafer) used to plate 6-inch wafers from 1000 to 2000 Oe. The soft iron is approximately 1.5 inches wide, and 0.5 inches thick. Proper shaping of the soft iron not only enables an improved magnetic flux concentration but it also provides a better uniformity of the magnetic field along the wafer and along the length of the tank. Note that in this example we use iron, but in actuality any conformable magnetic material may be used.

The iron pieces are said to be "floating" because they are not attached to either the wafer or the tank; they are simply placed around the wafer in the gaps between the wafer and the tank. This allows for the soft iron to be easily introduced into the tank and then subsequently removed.

Alternatively, according to another embodiment of the present invention, we embed the "floating magnet pole pieces" into the substrate wafer holders. We again use the term "floating" here because they are not attached, merely placed in the aqueous solution of the tank. The pole pieces may also be embedded in the substrate holder.

Referring now in specific detail to the drawings, and particularly FIG. 1, there is illustrated an embodiment according to the present invention wherein the magnetic poles 150 are shaped pieces of soft magnetic material extending around a wafer 108. The poles 150 are soft magnetic material added between the tank walls and wafer 108. The poles 150 are magnetized by the external magnet 100.

FIG. 1 shows such a magnet and tank-internal soft poles or flux concentrators 150 in a half-section at the midpoint of the magnet as they would appear crosswise relative to a tank. In the complete magnet 100 the parts shown are mirrored around the front (XY) plane. The tank walls are not shown but pass between the black hard magnet components 170 and the internal soft poles 150 shown as the smaller cross-hatched structures surrounding the wafer 108. The external horseshoe of soft magnet material (diagonal lines) 180 and hard magnet poles (black) 170 make up the external, moveable magnet 100 part of the invention. The wafer 108 lies in the X-Z plane centered on the axis arrows.

Figure 2:
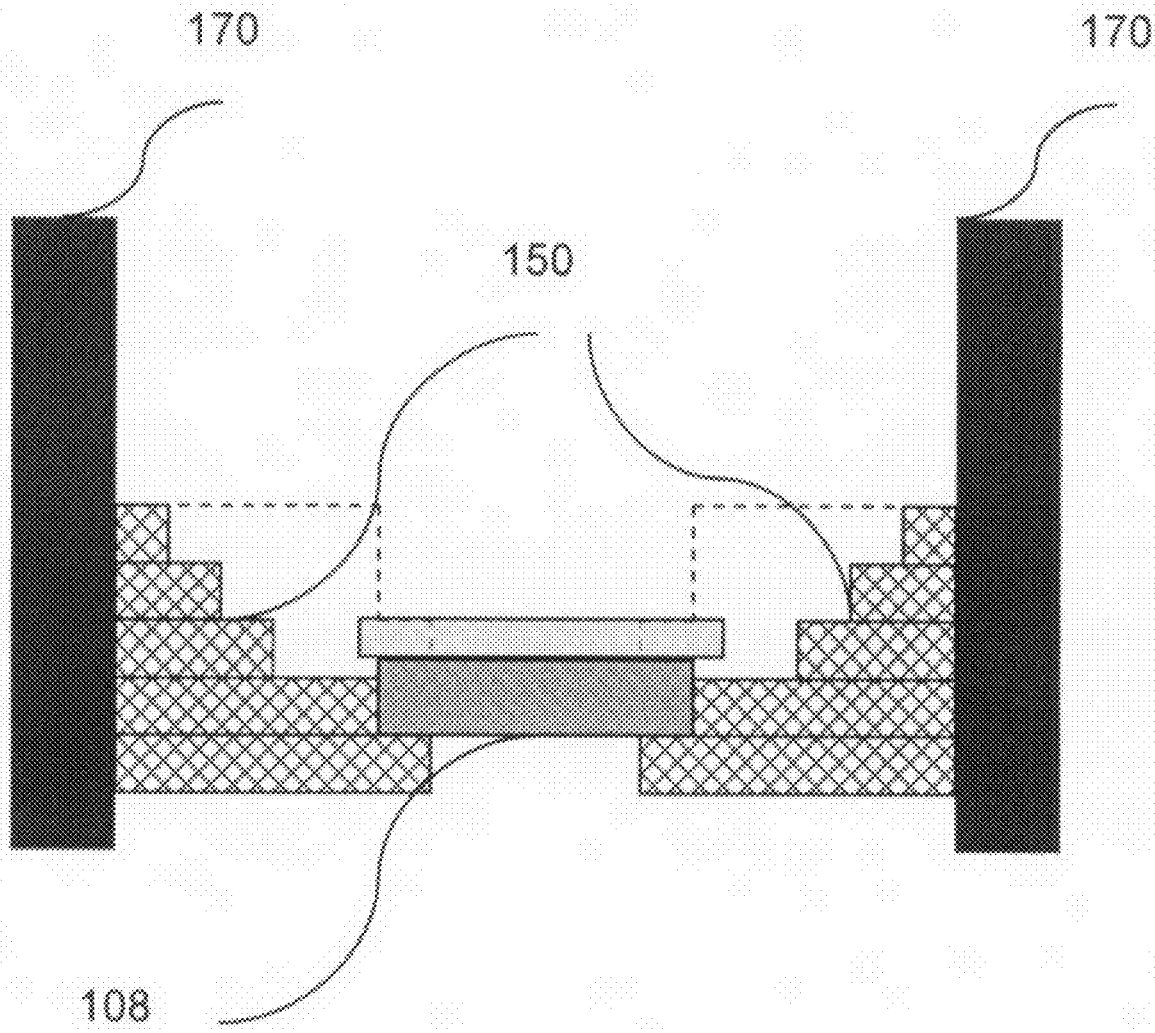
FIG. 2 is an illustration of another view of the soft magnetic poles of FIG. 1, according to an embodiment of the present invention.

The internal soft poles or flux concentrators 150 extend around the wafer 108 in the plane of the wafer 108 (X, Z) and under the wafer 108 (Y) direction. The desired magnetic field is in the X direction. For an external tank dimension of 12 inches the soft poles 150 in the drawing provide a field enhancement of 30% and a significant improvement in field uniformity over the wafer volume. A plating anode 120 is shown disposed over the substrate 108. The anode 120 is a removable plate of material made up of the magnetic material to be plated. The anode 120 is not attached to the substrate 108 and must be removed after plating. FIG. 2 shows a closer view of the tank poles 150 of FIG. 1.

Mathematical modeling of field distribution with the flux concentrators 150 is done to estimate the shape and the position in which the floating soft iron magnet poles or flux concentrators 150 would have to be placed in this commercially built magnet 100 to achieve the desired minimum 1000 Oe field in the center of an 8-inch wafer. The shape of the pole tip or flux concentrators 150 must also be calculated to provide a uniform magnetic field in the wafer area inside the plating tank.

Figure 8:
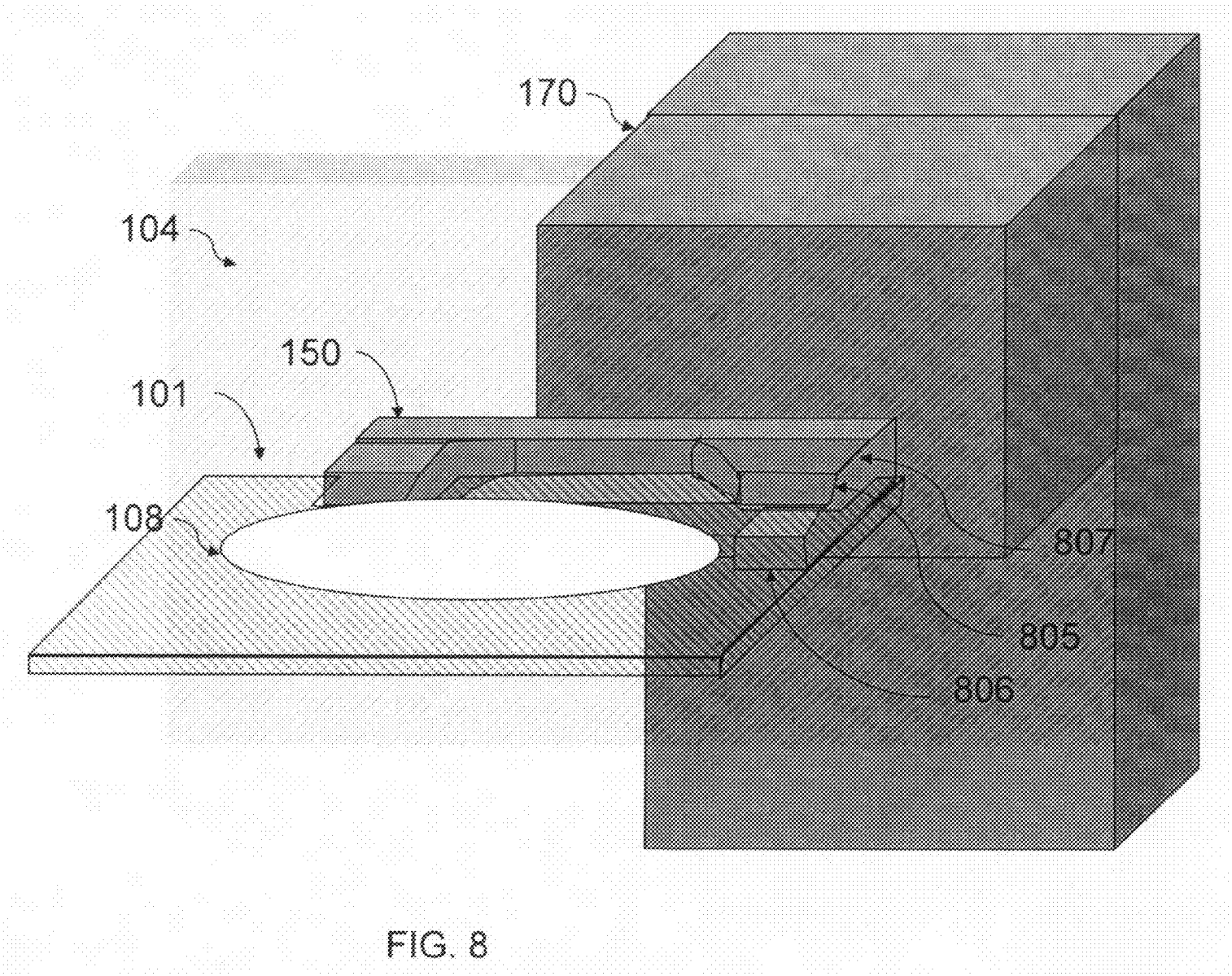
FIG. 8 shows a cut-away perspective drawing of the soft magnetic poles, showing the shaping of the soft magnetic material, according to an embodiment of the present invention.

Referring now to FIG. 8 there is illustrated a cut-away perspective highlighting the shape and placement of a typical flux concentrator within a plating tank. FIG. 8 shows the substrate 108 centered in the substrate holder 101, soft iron pole piece 150, part of one wall of the plating tank 104, and one permanent magnet pole 170. The exact shape of the soft iron flux concentrator 150 is determined by the mathematical modeling just described. As shown in FIG. 8, the soft iron pole piece 150 can extend above the substrate 108 (see pole portion 807); in the plane of the substrate 108 and into the region left empty by the round shape of the substrate 108 (see pole portion 805), and below and under the substrate 108 (see portion 806).

In this illustration the substrate holder 101 is cut away to allow the holder 101 to fit in separately from the soft iron poles 150. In another implementation, the flux concentrators 150 can be made part of the substrate holder 101. The flux concentrators 150 can be single pieces or made up of multiple pieces of soft iron assembled.

This solution enables the creation of a sufficiently large magnetic field inside the plating tank 104 on each side of the wafer 108 to scale the wafer size in fabrication of the tape heads to 8 inch wafers and eventually perhaps to 12 inch wafers.

The soft iron pole pieces 150, since they are "soft magnetic material highly permeable flux concentrators," are used to increase the magnetic field on the surface of the wafer 108. With proper magnetic flux distribution mathematically modeling the shape, the size and the location of the "floating flux concentrator pole tips" could be used to achieve a very uniform magnetic flux distribution over the entire wafer or to selectively increase the magnetic flux at any part of the surface of the wafer 108 being plated.

With a much higher magnetic field at the center of the wafer 108 it will be possible to achieve much better magnetic orientation of the deposited magnetic material, better magnetic anisotropy (smaller demagnetizing field at discontinuities) and thereby much better operation of the magnetic heads.

Moveable Magnet.

Referring again to FIG. 1, in order to facilitate the loading of the iron flux concentrators 150, and plating anodes 120 another embodiment of the present invention uses a moveable magnet (standard permanent magnets can be used) that exhibits relative movement alternately over and away from the tanks. The permanent magnet can be moved over and away from the tanks, or the tanks may be moved under and away from the tank. Large magnetic fields require high forces to move magnetic materials around; this restriction is avoided by moving the magnet away from the tank.

To describe this, we use an example of magnetic thin film plating of a wafer incorporating a permalloy plating tank, an annealing oven, and a high-moment plating tank. In this exemplary embodiment, the annealing oven is centered between the two plating tanks. Note that this embodiment is presented for describing enablement of this tool and should not be construed as a limitation of its configuration.

All three pieces of equipment and the moveable magnet 100 are placed on one set of rails, or track. This is accomplished in such a way that the magnet 100 can be moved by conventional crank mechanism from the first plating tank, positioned on one end of the rail to the annealing oven (positioned in the center) and then to the second plating tank. In this manner we can use only one magnet to create a magnetic field at a plurality of tanks or stations in different phases of the fabrication process. This approach lowers the cost of fabrication equipment by a considerable amount.

The moveable magnet 100 is moved along the track away from the plating tank when loading the iron flux concentrating pieces 150 and the nickel anode 120 and then the magnet 100 is moved into place for the plating operation when the cathode holder and the anode are in place. This allows for a very easy introduction of the flux concentrator 150, anode 120 and substrate holder and substrate 101 into the plating tank and also allows for easy removal. Placing the flux concentrators 150 directly into the tank allows the flux concentrators 150 to wrap around the round shape of the substrate 108 in a way they could not do outside of a rectangular tank.

In one configuration, the magnet 100 is mounted on a track with a plating tank at each end and an annealing station at the middle. When the magnet is moved away from a tank or station, the magnetic field at the tank or station is removed or reduced so that the substrate and any shaping or field enhancing components (flux concentrators 150) can be readily accessed and moved. The cost of the system is reduced since one magnet can be used in conjunction with multiple plating or annealing stations.

Figure 3:
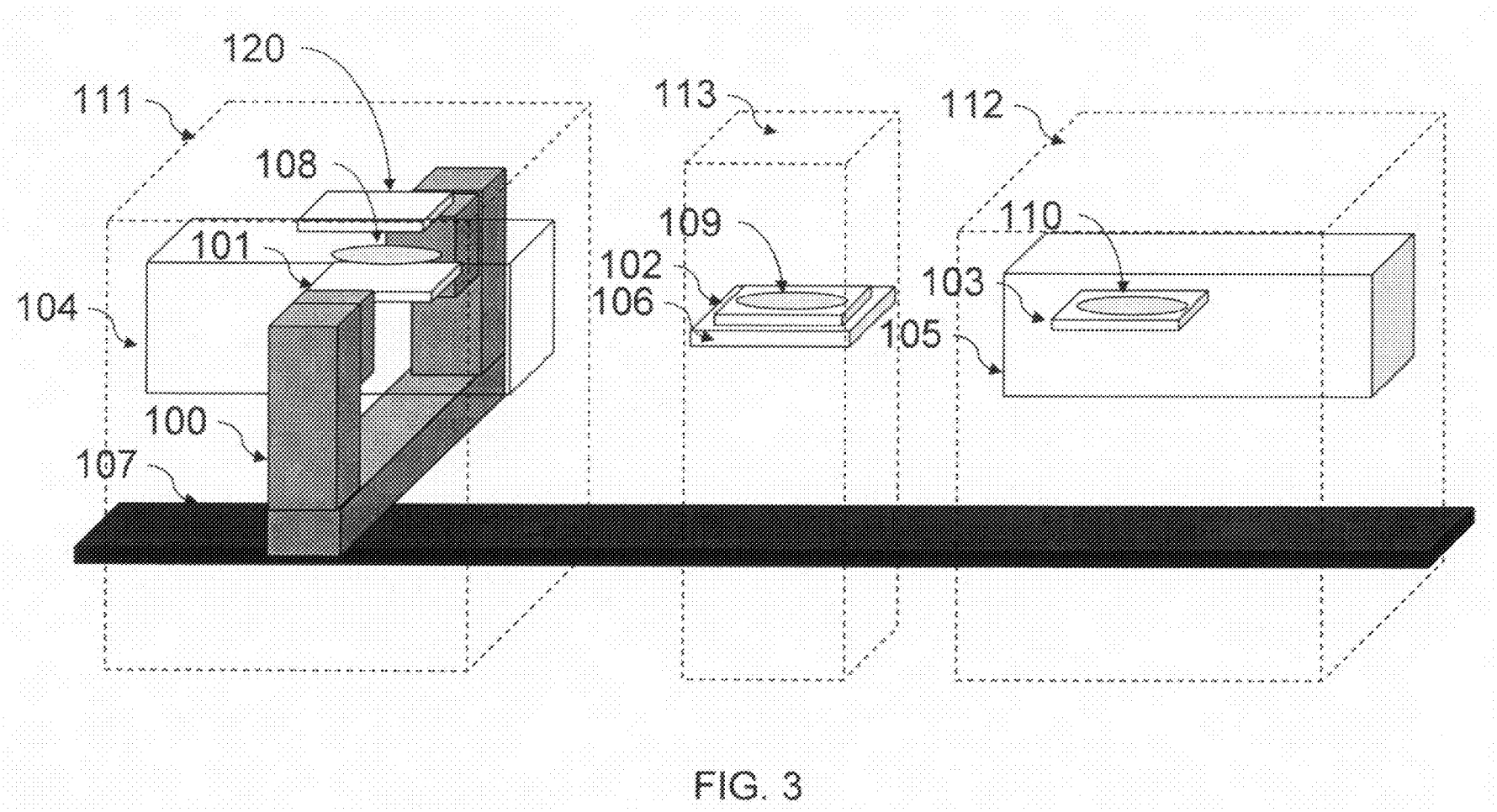
FIG. 3 shows a first position of the moveable magnet, according to an embodiment of the present invention.

Referring to FIG. 3 there is shown a first position of the moveable magnet 100 positioned at a first plating station 111. The magnet 100 is positioned on a magnet track 107. Note that the track 107 shown here is on the bottom of the tanks. In another embodiment the track may be above the tanks. The magnet 100 surrounds a permalloy plating tank 104. Permalloy ($Ni_{81}Fe_{19}$) combines 81% nickel with 19% iron by weight, introduced in the form of a plating anode 120. Situated in this plating tank 104 is a substrate holder 101 with a substrate 108 positioned in its center. The plating anode 120 can be replaced with anodes of other magnetic materials to plate those magnetic materials.

Figure 4:
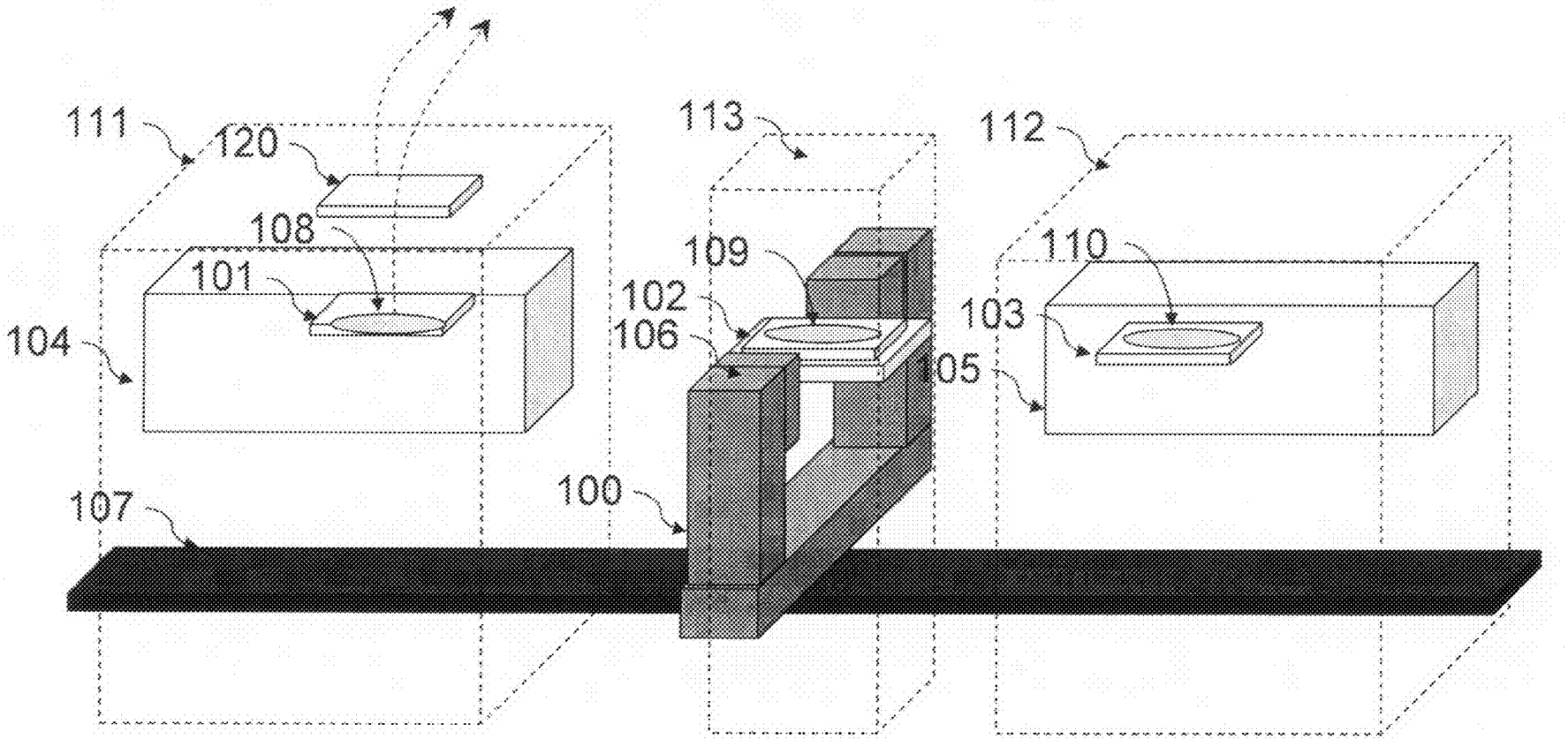
FIG. 4 shows a second position of the moveable magnet, according to an embodiment of the present invention.

FIG. 4 shows the moveable magnet 100 at the annealing station 113. The magnet 100 surrounds an annealing station heater 106. Within the heater 106 is a substrate holder 102 with a substrate 109.

Figure 5:
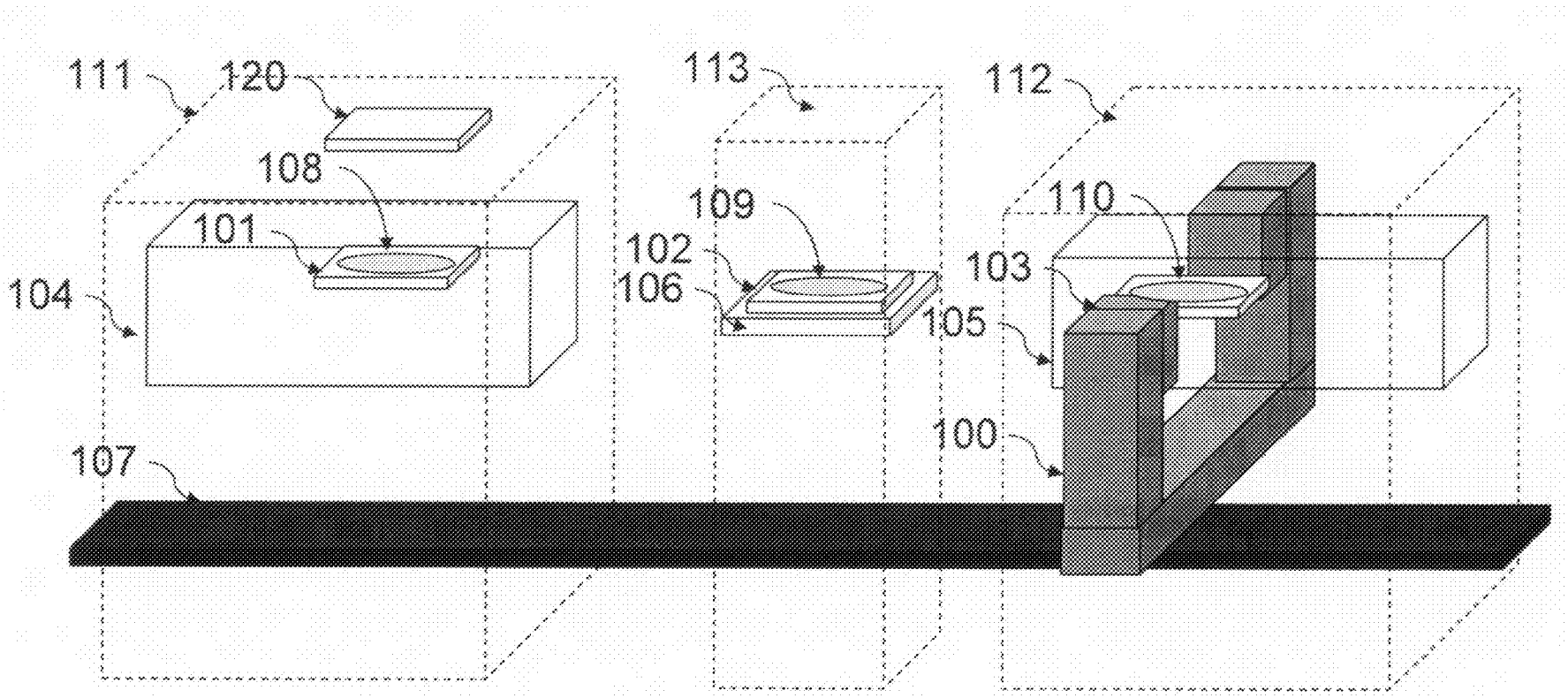
FIG. 5 shows a third position of the moveable magnet, according to an embodiment of the present invention.

FIG. 5 shows the moveable magnet 100 positioned at the second plating station 112. The magnet 100 surrounds a plating tank 105. The high moment plating tank 105 contains a substrate holder 103 with a substrate 110.

In another embodiment, the permanent magnet 100 is placed on one track 107, and the tanks are placed on a separate track, parallel to and underneath the first track. In yet another embodiment, only the permanent magnet 100 is placed on a track 107. The track 107 may be placed above the tanks rather than below the tanks. Other configurations of tanks and ovens are possible within the spirit and scope of the invention.

Figure 6:
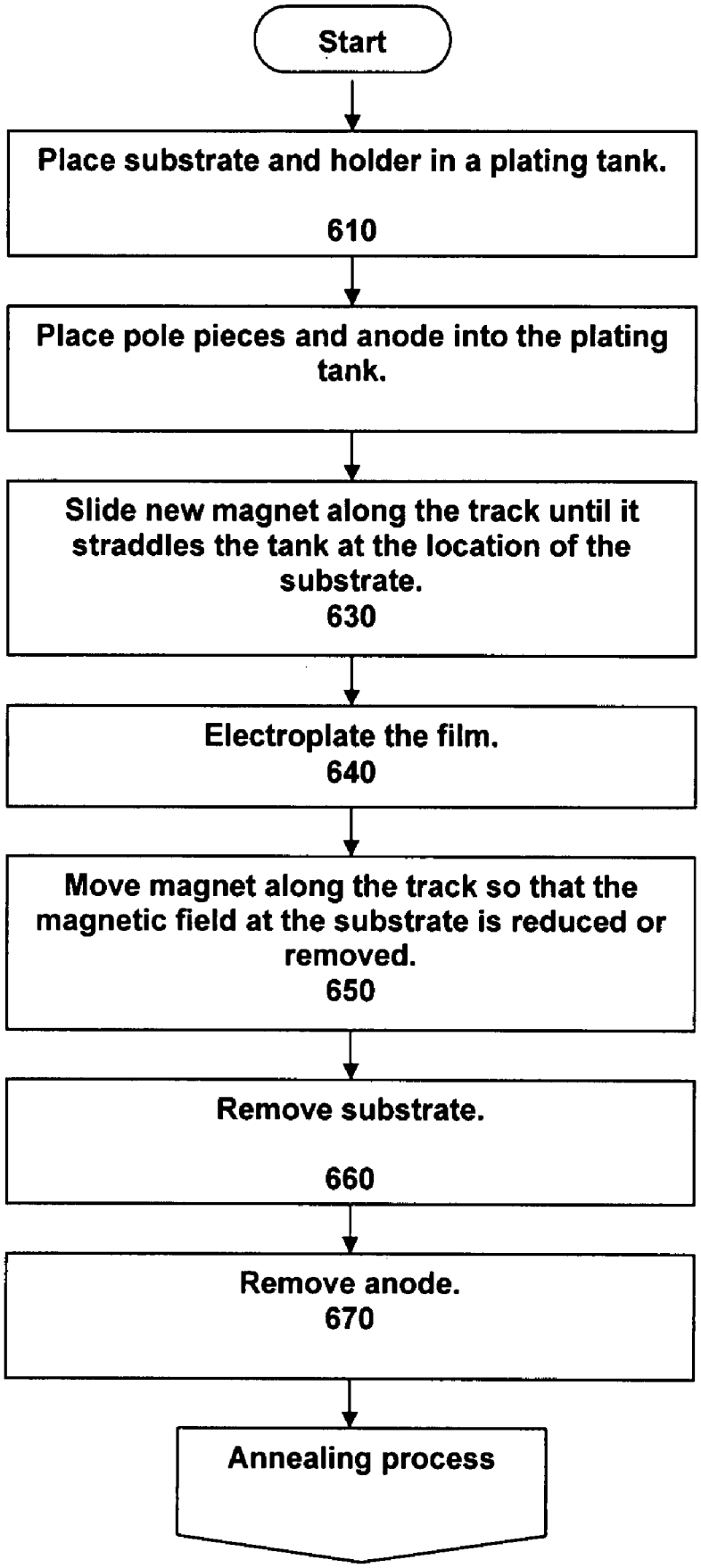
FIG. 6 is a flow chart of the process for plating a wafer using the moveable magnet, according to an embodiment of the present invention.

Referring to FIG. 6 there is shown a flow chart of the process for plating using the moveable magnet 100 as previously described. The process begins at step 610 when the substrate 108 and holder 101 are placed in the plating tank 104. Next, the soft magnetic material 150 is introduced into the tank in step 620. A plating anode 120 may optionally be placed over the substrate 108. In an alternate embodiment using the anode 120, the substrate 108 is placed over the anode 120; therefore, the anode 120 is positioned first, then the substrate 108 is placed in the tank 104.

In step 630 the magnet 100 is slid along the track 107 until the magnet 100 straddles the tank 104 at the location of the substrate 108. There can be more than one location for substrates within the tank 104. Referring back to FIG. 5 it is shown that the substrate in tank 104 is located in a different position than the substrate in tank 105.

In step 640 the film 108 is electroplated using conventional means and in step 650 the magnet 100 is then moved away from the tank 104 along the track 107 so that the magnetic field at the substrate 108 is removed or reduced. Then, in step 660 the pole pieces 150 are removed from the tank 104 and the anode 120 is also removed. Lastly, in step 670 the electroplated film 108 is then removed. By having two or more plating tanks, one tank can be used for plating while the other tank is accessible for maintenance or substrate addition or removal.

Figure 7:
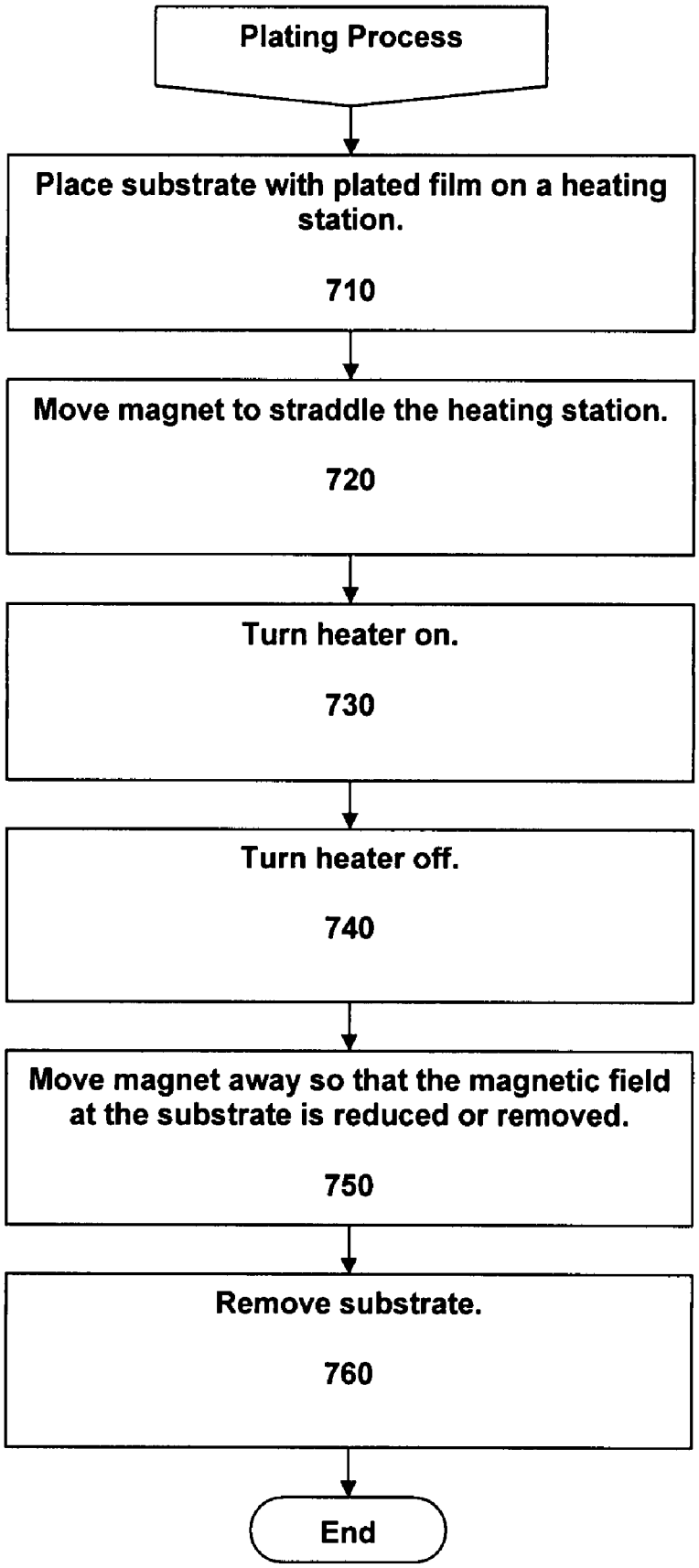
FIG. 7 is a flow chart of the process for annealing the plated wafer, according to an embodiment of the present invention.

Continuing, the magnet 100 is moved to another tank for the annealing process. Referring to FIG. 7 there is shown a flow chart of the process for annealing plated films in a field using the moveable magnet 100. The process begins at step 710 when the substrate 109 with plated film is placed on a heating station 106. In step 720 the magnet 100 is moved to straddle the heating station 106. In step 730 the heater 106 is turned on and the plated film 109 experiences a raised temperature while within the magnetic field of the magnet 100. Annealing is a known process, accomplished at temperatures ranging from 120 degrees Celsius to 300 degrees Celsius.

In step 740 the heater 106 is turned off. Once the heater 106 is turned off the magnet 100 can then be moved away in step 750 so that the magnetic field at the substrate 109 is removed or reduced. Lastly, in step 760 the annealed substrate 110 is removed.

The substrate 110 can then be moved to another plating station 112 where it is placed in a plating tank 105. In this embodiment, the tank 105 is a high moment plating tank for subsequent plating of the annealed film 110. The annealed film 110 is centered on a substrate holder 103. The process then continues just as described with respect to FIG. 6.

Figure 9:
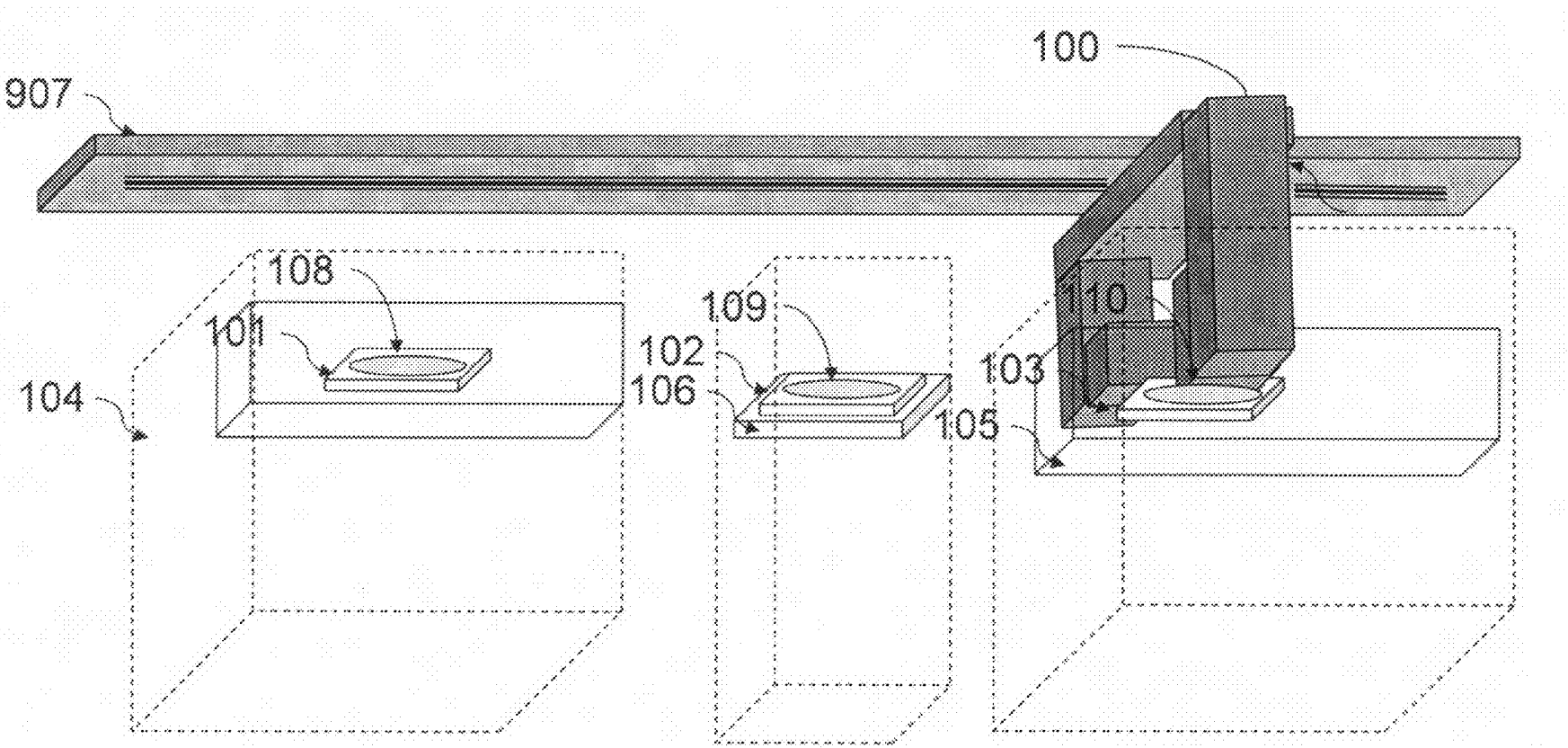
FIG. 9 shows the moveable magnet on a track above the plating tanks, according to another embodiment of the present invention.
Figure 10:
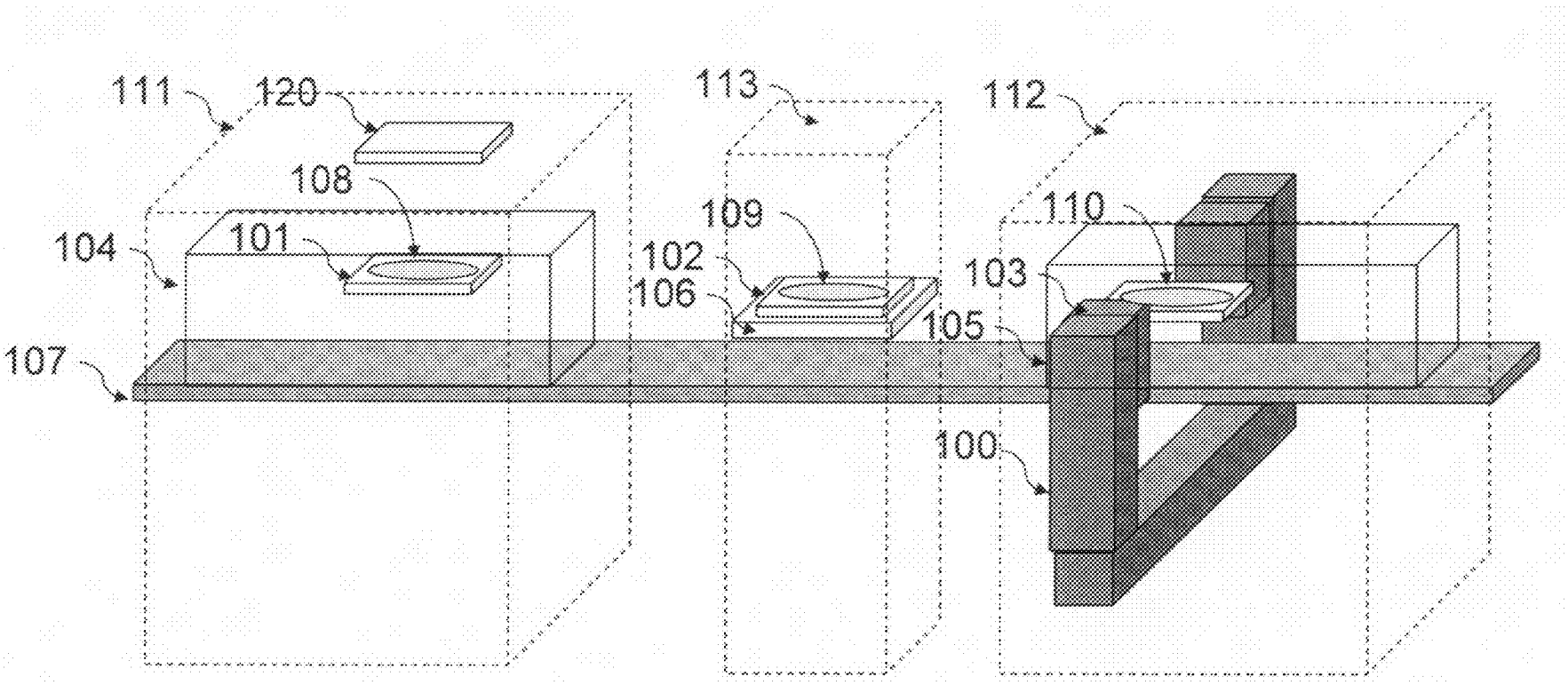
FIG. 10 shows a stationary magnet with the plating tanks and annealing oven positioned on the moveable track, according to another embodiment of the present invention.

FIG. 9 shows another embodiment wherein the magnet 100 is mounted on a moveable track 907 situated above the plating tanks, rather than beneath the tanks. In another embodiment, as shown in FIG. 10, the magnet 100 remains stationary and the tanks move along the moveable track 107.

This invention allows magnetic storage head manufacturers to move from 6-inch diameter wafers to 8-inch diameter wafers and eventually to 12-inch wafers, each time utilizing the just abandoned fabrication areas by the semiconductor device manufacturers. At the same time with proper mathematical modeling it is possible to achieve magnetic fields on the wafer which can be at least double the magnetic fields used in the industrial plants today.

Therefore, while there has been described what is presently considered to be the preferred embodiment, it will understood by those skilled in the art that other modifications can be made within the spirit of the invention. The above descriptions of embodiments are not intended to be exhaustive or limiting in scope. The invention, as described above, can be advantageously used in any process involving the plating of magnetic films where an applied magnetic field is desired during plating. The embodiments, as described, were chosen in order to explain the principles of the invention, show its practical application, and enable those with ordinary skill in the art to understand how to make and use the invention. It should be understood that the invention is not limited to the embodiments described above, but rather should be interpreted within the full meaning and scope of the appended claims.

The invention claimed is:

1. A method for enhancing a magnetic field when plating magnetic film on a substrate, the method comprising:

loading the substrate into a plating tank;

introducing a conformable flux concentrator into the plating tank, wherein the conformable flux concentrator is inserted into gaps between the substrate and inside walls of the plating tank, substantially surrounding the substrate and extending around and under the substrate;

positioning a magnet around the plating tank;

electroplating the substrate using the magnet to magnetize the conformable flux concentrator;

relatively moving the magnet away from the plating tank; and removing the substrate from the plating tank.

2. The method of claim 1 further comprising removing the conformable flux concentrator from the plating tank.

3. The method of claim 1 further comprising:

installing an anode into the plating tank before positioning the magnet around the plating tank, wherein the anode is disposed above the substrate; and removing the anode after relatively moving the magnet away from the plating tank.

4. The method of claim 1 further comprising performing mathematical modeling of the magnetic flux distribution of the conformable flux concentrator to determine an ideal shape, size, and location of the conformable flux concentrator around the substrate.

5. The method of claim 4 further comprising shaping the conformable flux concentrator from high permeability soft iron.

6. The method of claim 5 wherein shaping comprises shaping the conformable flux concentrator such that at least one piece extends along a width of the substrate.

7. The method of claim 1 further comprising:

installing an anode into the plating tank before loading the substrate, wherein the anode is disposed underneath the substrate; and removing the anode after removing the substrate.

8. A method for plating magnetic film on a substrate, the method comprising:

mounting a permanent magnet on a track comprising a plurality of stopping points, wherein the permanent magnet is movable along the track;

positioning a first cell on a first stopping point, wherein the first cell comprises an aqueous solution and the substrate is disposed within the aqueous solution;

inserting a conformable flux concentrator into the first cell, such that the conformable flux concentrator is inserted into gaps between the substrate and inside walls of the first cell, substantially surrounding the substrate and extending around and under the substrate;

moving the permanent magnet along the track to the first stopping point wherein the magnet surrounds the first cell when positioned; and wherein the permanent magnet magnetizes the substrate disposed within the first cell, wherein the magnetization is facilitated by the conformable flux concentrator, and electroplating a magnetic film onto the substrate; and moving the permanent magnet along the track to a second stopping point to facilitate removal of the substrate and the conformable flux concentrator.

9. The method of claim 8 further comprising:

positioning additional cells on additional stopping points; and moving the permanent magnet along the track to the additional stopping points.

10. A method for plating magnetic film on a substrate, the method comprising:

aligning a track comprising a plurality of stopping points along an x plane of a permanent magnet, wherein the permanent magnet is disposed over a first stopping point;

mounting an electrolytic cell on the track, wherein the electrolytic cell is movable along the track and wherein the electrolytic cell comprises an aqueous solution and the substrate is disposed within said aqueous solution;

inserting a conformable flux concentrator into the electrolytic cell, such that the conformable flux concentrator is inserted into gaps between the substrate and inside walls of the electrolytic cell, substantially surrounding the substrate and extending around and under the substrate;

moving the electrolytic cell to the first stopping point on the track wherein the permanent magnet surrounds the electrolytic cell when positioned; and wherein the permanent magnet magnetizes the substrate disposed within the electrolytic cell, wherein the magnetization is facilitated by the conformable flux concentrator, and electroplating a magnetic film onto the substrate; and moving the electrolytic cell along the track to a second stopping point to facilitate removal of the substrate and the conformable flux concentrator.

11. The method of claim 10 further comprising mounting additional electrolytic cells on the track.

* * * * *